US008444422B2

(12) United States Patent
Lin

(10) Patent No.: US 8,444,422 B2
(45) Date of Patent: May 21, 2013

(54) COAXIAL CONNECTOR

(75) Inventor: Wen Wei Lin, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 48 days.

(21) Appl. No.: 13/339,827

(22) Filed: Dec. 29, 2011

(65) Prior Publication Data

US 2013/0084739 A1 Apr. 4, 2013

(30) Foreign Application Priority Data

Sep. 30, 2011 (CN) ..... 2011 2 0373937 U

(51) Int. Cl.
*H01R 12/00* (2006.01)

(52) U.S. Cl.
USPC ..... 439/63; 439/188

(58) Field of Classification Search
USPC ..... 439/63, 188
See application file for complete search history.

(56) References Cited

U.S. PATENT DOCUMENTS 6,761,571 B2 * 7/2004 Hida ..... 439/188
6,932,615 B1 * 8/2005 Yeo ..... 439/63
7,513,778 B1 * 4/2009 Dar-Shan ..... 439/63
7,726,992 B2 * 6/2010 Wang et al. ..... 439/188
7,794,253 B2 * 9/2010 Wang et al. ..... 439/188
8,066,516 B2 * 11/2011 Hoshiba et al. ..... 439/63
2007/0117435 A1 * 5/2007 Nakagawa ..... 439/188
2010/0227481 A1 * 9/2010 Liao et al. ..... 439/63
2011/0076869 A1 * 3/2011 Braem et al. ..... 439/188
2011/0159708 A1 * 6/2011 Huang et al. ..... 439/63

* cited by examiner

*Primary Examiner* — Gary F. Paumen
(74) *Attorney, Agent, or Firm* — Morris Manning & Martin LLP; Tim Tingkang Xia, Esq.

(57) ABSTRACT

A coaxial connector includes a lower insulating seat, having a housing cavity recessed from an upper surface thereof, and a receiving slot is located on one side of the housing cavity; a movable terminal, having a retained portion retained in the receiving slot, a pressed portion extended from the retained portion, a first soldering portion bent downwards and extended from the retained portion, and a first strip-connecting portion extended outwards from the retained portion and coplanar with the retained portion; and a fixed terminal, having a fixed portion embedded in the lower insulating seat and coplanar with the retained portion, a pressing portion extended from the fixed portion and urging against the pressed portion, a second soldering portion extended from the fixed portion, and coplanar with the first soldering portion, a second strip-connecting portion extends from the second soldering portion, and in different planes with the first strip-connecting portion.

18 Claims, 9 Drawing Sheets

COAXIAL CONNECTOR

CROSS-REFERENCE TO RELATED APPLICATIONS

This non-provisional application claims priority under 35 U.S.C. §119(a) on Patent Application No. 201120373937.5 filed in P.R. China on Sep. 30, 2011, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention generally relates to a coaxial connector, and more particularly to a switch-equipped coaxial connector.

BACKGROUND OF THE INVENTION

In mobile phones and other portable communication tools, switch-equipped coaxial connectors are widely applied in high-frequency circuits. With the rapid development of science and technology, electronic products are developed in a trend of being lighter, thinner, shorter, and smaller. Especially in the communication industry, with the miniaturization of the overall system of the mobile phone, the size of the applied coaxial connector becomes smaller and smaller.

A coaxial connector in the related art includes an insulating casing, and the insulating casing has an empty cavity to be inserted into by a coupling plug downwards from top. A fixed terminal and a movable terminal are disposed in the insulating casing, and enter the empty cavity respectively. When the coupling plug is not inserted, a free end of the fixed terminal is located above a free end of the movable terminal, and exerts an elastic pressing force on the free end of the movable terminal, so that the free end of the fixed terminal and the free end of the movable terminal are in close contact with each other. When the coupling plug is inserted downwards into the empty cavity and presses against the movable terminal, the free end of the movable terminal departs from the free end of the fixed terminal, thereby realizing a switch function. In order to ensure a normal force between the fixed terminal and the movable terminal to ensure good contact between the fixed terminal and the movable terminal, the movable terminal is usually made into a structure having a bend, so as to make the movable terminal more elastic. The method of bending the movable terminal to increase the normal force makes the manufacturing process complicated, and the bent terminal occupies more space, which is not conducive to miniaturization of the coaxial connector.

In order to solve the problem, another type of coaxial connector emerges in the industry, as disclosed in Chinese Patent No. CN97113618.1, where the coaxial connector includes an insulating casing having an empty cavity to at least accommodate a center contact member of a coupling coaxial connector, and an internal terminal, disposed in the empty cavity of the insulating casing and protruding in a direction substantially perpendicular to an insertion direction of the center contact member. The internal terminal is formed by a fixed terminal and a movable terminal capable of being connected to or separated from each other. The movable terminal and the fixed terminal are inserted into the empty cavity through corresponding slots respectively. The internal terminal of the coaxial connector is designed to be substantially in the shape of a flat board, an extension direction of which is perpendicular to the insertion direction of the center insertion member. The bend structure on the movable terminal is saved, which can reduce the size and thickness of the coaxial connector, but is likely to incur the following problems.

1. Two sides of the insulating casing are opened with slots respectively for the movable terminal and the fixed terminal to be inserted into the empty cavity, and two sides of the empty cavity of the small insulating casing are opened with holes respectively, which makes the dimensional accuracy of the slots difficult to be control, and reduces the overall strength of the insulating casing, thereby likely cracking the insulating casing.

2. The movable terminal and the fixed terminal are both of the insertion structure, and the orthogonality between individual terminals and the individual slots is required to be adjusted respectively to reduce the deviation between the terminals and the slots, incurring an additional assembly procedure.

3. The movable terminal and the fixed terminal are both of the insertion structure, so that during insertion the relative positions between the movable terminal and the fixed terminal are required to be controlled precisely to ensure the sufficient normal force between the movable terminal and the fixed terminal, thereby making the assembly more difficult.

Another coaxial connector is in common use in the industry, as disclosed in Chinese Patent No. CN200920134096.5, where the coaxial connector includes an insulating main body having a seat, where a receiving slot is formed in the seat; an internal terminal disposed in the receiving slot of the seat; and a detecting terminal. The detecting terminal is formed on the seat of the insulating main body by insert molding. The detecting terminal has an electrical contact piece which is inserted into the receiving slot and fixed in the detecting terminal. A free section of the internal terminal contacts with the electrical contact piece when free of any external force. A soldering piece is extended from the detecting terminal and a soldering piece is extended from the internal terminal, and the two soldering pieces are both bent inwards and L-shaped, and extend towards each other.

In order to facilitate mass production, no matter the terminal is inserted into the insulating main body or the terminal is formed on the insulating main body by insert molding, a connecting-strip method is usually employed. That is to say, multiple terminals are connected by the same strip, and are inserted into multiple insulating main bodies correspondingly at the same time or formed on multiple insulating main bodies by insert molding at the same time. The strip is broken and removed after the terminals are mounted. In the coaxial connector the soldering pieces of the detecting terminal and the internal terminal are both bent inwards and L-shaped, and extend towards each other, so that a strip-connecting portion of the detecting terminal can only be disposed at a rear portion of the electrical contact section of the detecting terminal and above two sides of the soldering piece, and the a strip-connecting portion of the internal terminal can only be disposed a rear portion of the fixed section of the internal terminal and above two sides of the soldering pieces.

The strip-connecting portions of the detecting terminal and the internal terminal are in general substantially coplanar, and in a position slightly above the center of the insulating main body in the vertical direction. The detecting terminal is formed on the seat of the insulting main body by insert molding, in this way although the structure can improve the positioning accuracy of the detecting terminal in the insulating main body and ensure the normal force between the detecting terminal and the internal terminal, the thickness of the insulating main body is small, and the strip-connecting portion is in the middle, so that upon breaking of the strip, the inevitable vertical vibration of the strip-connecting portion causes the insulating main body to crack to be damaged.

Therefore, a heretofore unaddressed need exists in the art to address the aforementioned deficiencies and inadequacies.

SUMMARY OF THE INVENTION

In one aspect, the present invention is directed to a coaxial connector having a firm structure, and the coaxial connector is able to not only ensure a normal force of terminals of a switch but also make mounting of the terminals of the switch and the insulating main body convenient, and is not likely to damage the insulating main body.

In one embodiment, a coaxial connector according to the present invention is used to be coupled to a mating electrical connector inserted downwards, and includes a lower insulating seat, a movable terminal, a fixed terminal, an upper insulating seat, and a metal shell.

The lower insulating seat has an upper surface and a lower surface opposite to each other. A housing cavity is recessed from the upper surface. The lower insulating seat is disposed with a receiving slot located on one side of the housing cavity and in communication with the housing cavity. The lower insulating seat is further disposed with a protruding reinforcing block located on a periphery of the receiving slot.

The movable terminal has a retained portion retained in the receiving slot. A contact portion extends transversely from one end of the retained portion and enters the housing cavity. A pressed portion extending transversely from the contact portion is located in the housing cavity. A first soldering portion is bent downwards and extends from the other end of the retained portion. A first strip-connecting portion extends from the retained portion in a direction leaving the housing cavity. The first strip-connecting portion and the contact portion are substantially coplanar.

The fixed terminal integrally embedded in the lower insulating seat and has a fixed portion embedded in the lower insulating seat. The fixed portion and the retained portion of the movable terminal are coplanar. A pressing portion extends transversely from one end of the fixed portion and enters the housing cavity. The pressing portion elastically presses downwards against the pressed portion. A second soldering portion is bent downwards from the other end of the fixed portion, extends in a direction leaving the housing cavity, and is exposed from the lower surface. The second soldering portion and the first soldering portion are coplanar. A second strip-connecting portion extends transversely from the second soldering portion, and the second strip-connecting portion and the first strip-connecting portion are in different planes.

The upper insulating seat is mounted on the upper surface of the lower insulating seat. The upper insulating seat is disposed with an insertion slot to be inserted into by the mating electrical connector and in communication with the housing cavity. A guiding slope is disposed in the insertion slot to guide the mating electrical connector to enter.

The metal shell is disposed on a periphery of the upper insulating seat. The metal shell has an embracing portion bent and extending towards the lower insulating seat for embracing the lower surface of the lower insulating seat. An outer side of the metal shell is disposed with a holding portion to hold the mating electrical connector. When the mating electrical connector enters the insertion slot from the guiding slope and urges against the contact portion of the movable terminal, and a casing of the mating electrical connector is held at the holding portion on the outer side of the metal shell, the pressed portion of the movable terminal is separated from the pressing portion of the fixed terminal, thereby forming a switch circuit capable of switching a signal.

In another embodiment, the movable terminal and the fixed terminal are disposed to be opposite to each other, and the pressed portion and the pressing portion extend towards each other.

In yet another embodiment, the first soldering portion extends in a direction leaving the housing cavity.

In a further embodiment, the housing cavity has a bottom wall located under the movable terminal, and after the pressed portion is separated from the pressing portion, the bottom wall stops the movable terminal.

Further, a distance from the bottom wall to the movable terminal increases gradually along a direction from the retained portion to the pressed portion.

Further, the bottom wall is a slope or a curved surface.

Further, the reinforcing block is disposed at the upper surface, and contacts with the metal shell laterally to limit the metal shell.

Further, the movable terminal is disposed with two first strip-connecting portions located on two sides of the retained portion, two support points disposed in the receiving slot are located under the first strip-connecting portions, and the two support points urge against the two first strip-connecting portions respectively.

In another embodiment, the upper insulating seat has a lower wall surface fit with the upper surface of the lower insulating seat, and a gap exists between the lower wall surface and the movable terminal.

Further, the lower wall surface is disposed with a positioning protrusion which protrudes towards the lower insulating seat and enters the housing cavity.

In another embodiment, the housing cavity has a side wall, and the side wall is a slope to guide the positioning protrusion to enter the housing cavity.

Further, the upper insulating seat is integrally embedded in the metal shell.

Further, the pressed portion of the movable terminal is bifurcated to form two contact points contacting with the pressing portion.

Further, the lower surface of the lower insulating seat is disposed with a recessed make-way slot corresponding to the embracing portion, and a free end of the embracing portion enters the make-way slot.

Further, a part of the make-way slot close to the middle of the lower surface is inclined upwards.

Further, a pointed portion protruding from the pressing portion contacts with the pressed portion. Alternately, a pointed portion protruding from the pressed portion contacts with the pressing portion.

Compared with the related art, in the present invention, among other things, the contact portion of the movable terminal extends transversely from the retained portion without being bent. The fixed terminal is also in the shape of a flat board. The two terminals are simple in structure, which simplifies the manufacturing process and reduces the space occupied by the two terminals in a vertical direction, thereby being conducive to making the coaxial connector thinner and smaller. On the basis that the retained portion of the movable terminal and the fixed portion of the fixed terminal are coplanar, the pressed portion extends to the position under the pressing portion, and the structure can ensure a sufficient normal force between the two terminals being very simple in structure.

The fixed terminal is integrally embedded in the lower insulating seat by insert molding, so that the structure is easy to manufacture and has the steady size. The movable terminal is mounted in the receiving slot by inserting after the lower insulating seat is formed and cooled, so that a normal force between the movable terminal and the fixed terminal is enabled to be large, and at the same time the lower insulating seat is prevented from being deformed by a pushing effect exerted by the normal force of the two terminals during a cooling process after the insert molding.

The movable terminal and the fixed terminal can be respectively connected to the strips for insert molding, and inserted into the lower insulating seat, thereby making mass mounting and production convenient and simplifying the assembly process. The first strip-connecting portion of the movable terminal is slightly above the middle of the lower insulating seat in a vertical direction, so that when the movable terminal is being inserted into the receiving slot the movable terminal endures a concentrated force, which makes the insertion easier. The reinforcing block above the receiving slot can increase the strength of the lower insulating seat, so that when the movable terminal is being inserted into the receiving slot or the strip is being broken, a too heavy impact caused by the movable terminal does not crack the lower insulating seat.

The second strip-connecting portion of the fixed terminal is located on the lower surface of the lower insulating seat, so that compared with the structure in the prior art in which the strip-connecting portion is in the middle of the insulating main body, when the strip of the fixed terminal is being broken, even if the strip-connecting portion vibrates vertically, the strip-connecting portion contacts with only the lower surface, which dose not cause the lower insulating seat to crack. In short, the second strip-connecting portion and the first strip-connecting portion are not in the same plane in the vertical direction, at the same time of ensuring that the movable terminal can be inserted successfully, the lower insulating seat can be prevented from cracking when the strip is being broken, thereby improving the reliability of the coaxial connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
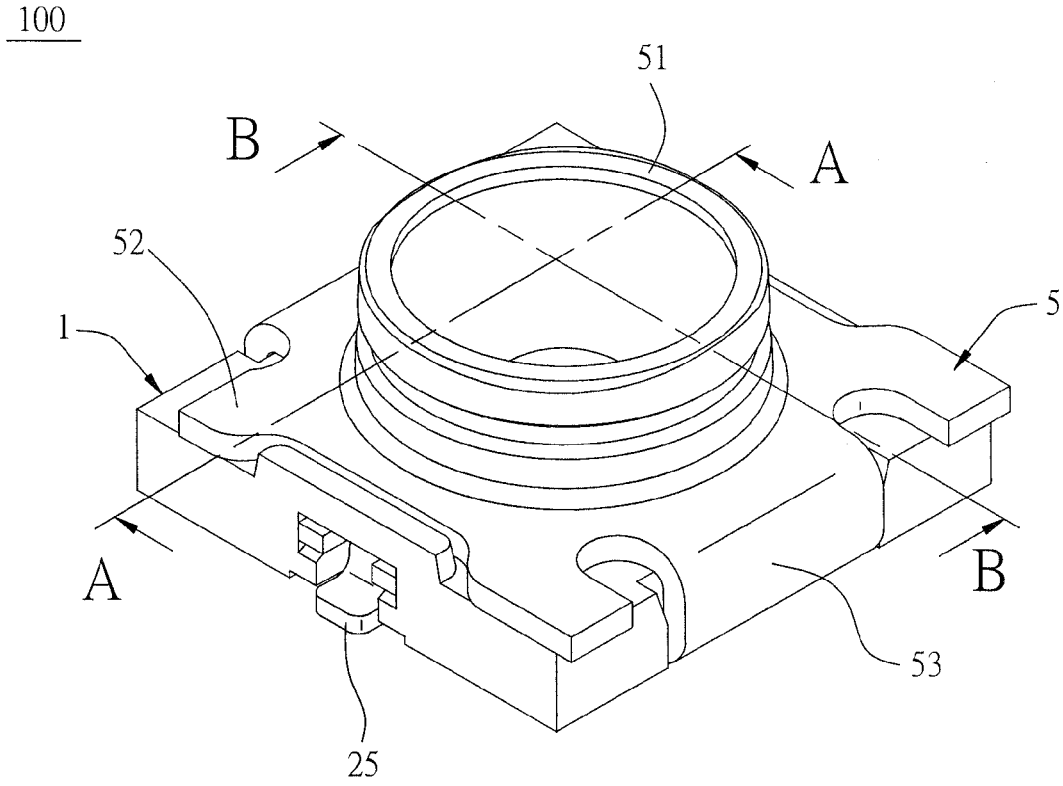
FIG. 1 is a schematic three-dimensional view of a coaxial connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 4:
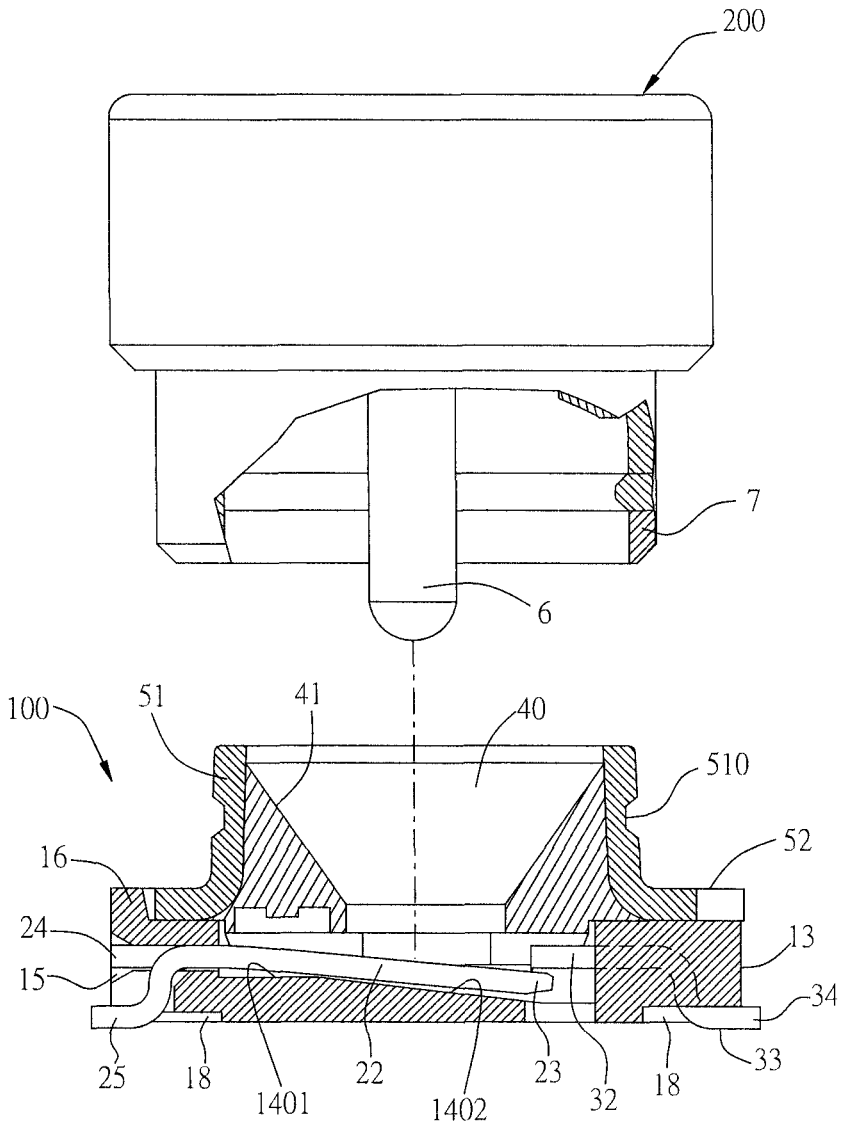
FIG. 4 is a schematic view before a mating electrical connector is inserted into a coaxial connector according to one embodiment of the present invention.

Referring to FIGS. 1 and 4, a coaxial connector 100 according to one embodiment of the present invention may be coupled to a mating electrical connector 200, and includes a lower insulating seat 1, in which a movable terminal 2 and a fixed terminal 3 are disposed to realize a switch function; an upper insulating seat 4 mounted above the lower insulating seat 1; and a metal shell 5 disposed on a periphery of the upper insulating seat 4. As shown in FIG. 4, the mating electrical connector 200 includes a pin 6 and a casing 7 embracing the pin 6.

Figure 2:
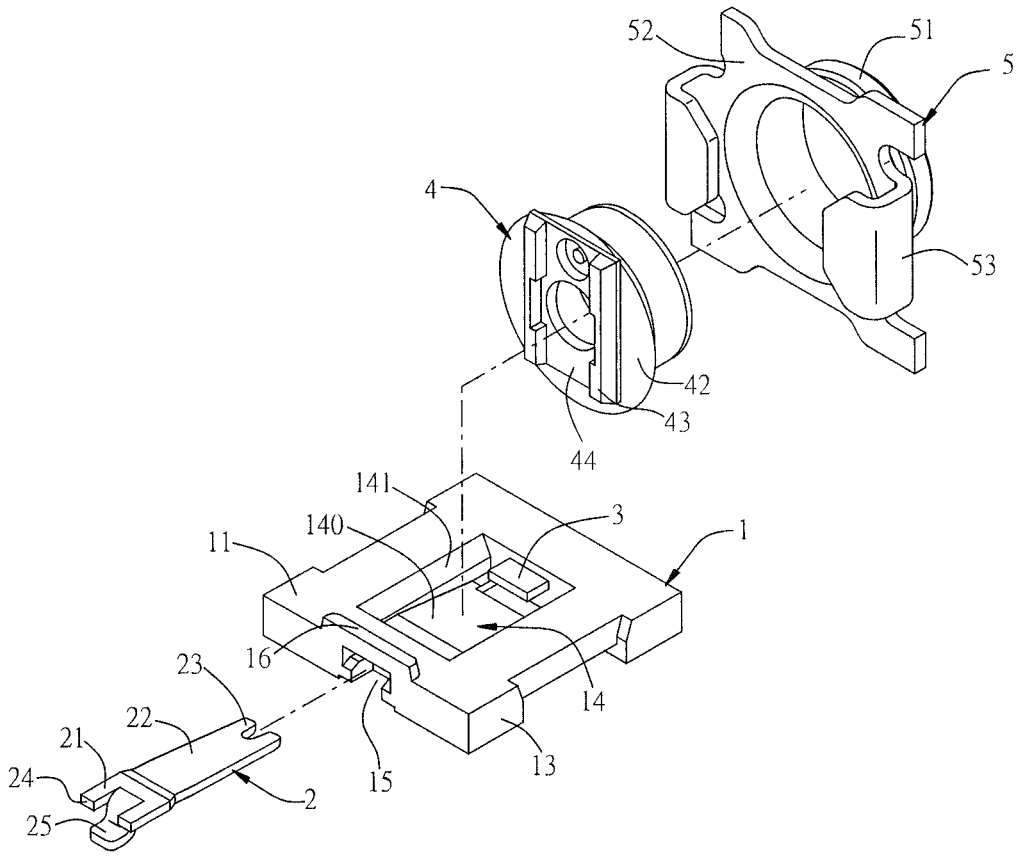
FIG. 2 is a schematic exploded view of a three-dimensional structure of a coaxial connector according to one embodiment of the present invention.
Figure 3:
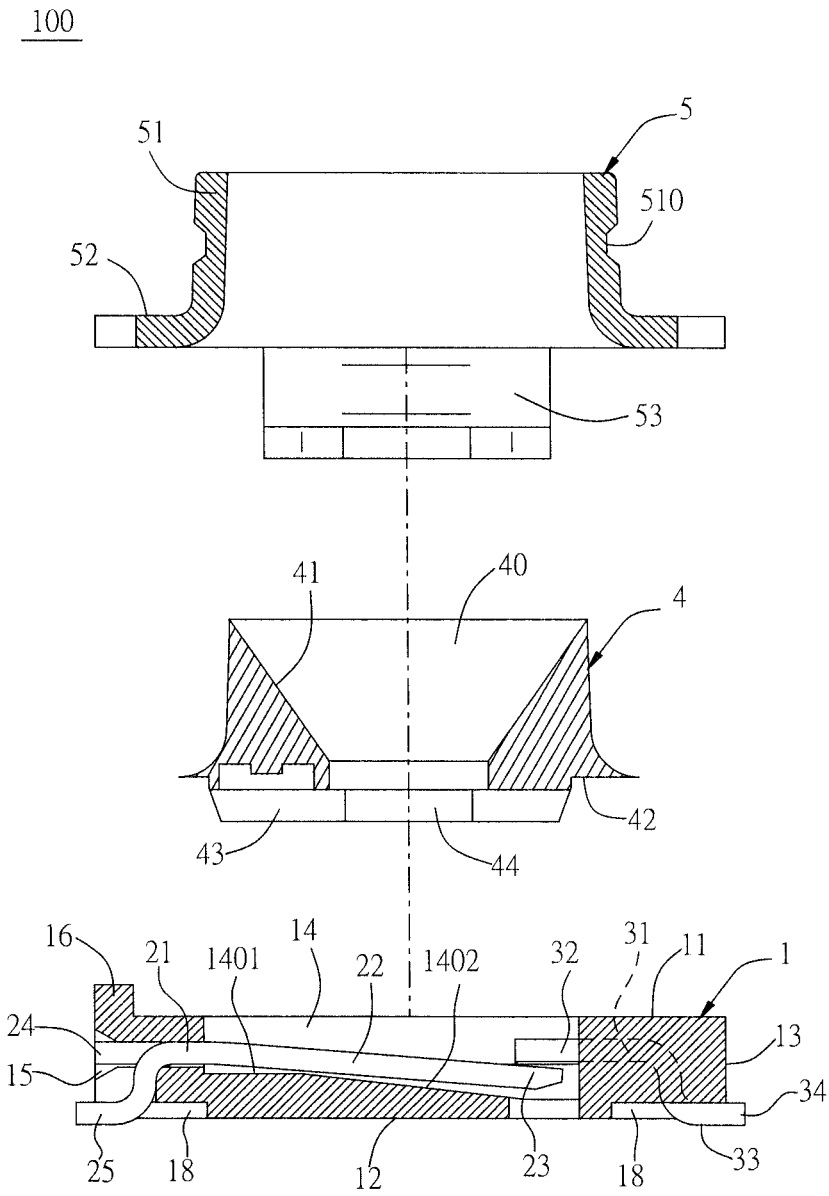
FIG. 3 is an exploded cutaway view along an A-A line in FIG. 1.

Referring to FIGS. 1-3, the lower insulating seat 1 is in the form of a square cuboid, and has an upper surface 11, a lower surface 12 opposite to the upper surface 11, and four side surfaces 13. The lower insulating seat 1 has a housing cavity 14 recessed from the upper surface 11. The lower insulating seat 1 has a receiving slot 15 opened inwards from one of the side surfaces 13. The receiving slot 15 is located on one side of the housing cavity 14, in communication with the housing cavity 14, and located at a middle position of the side surface 13. The housing cavity 14 has a bottom wall 140 and four side walls 141. The bottom wall 140 slopes gradually away from the upper surface 11, that is, the bottom wall 140 is not horizontal. In this embodiment, the bottom wall 140 is formed by a horizontal plane 1401 and a slope 1402, the horizontal plane 1401 is close to an outer side of the housing cavity 14, a gap is formed between the horizontal plane 1401 and a lower surface of the movable terminal 2, and the slope 1402 is substantially located in the middle of the housing cavity 14. Definitely in other embodiments, the bottom wall 140 may also be curved provided that a distance from a pressed portion to the bottom wall 140 is greater than that from a contact portion to the bottom wall 140. The bottom wall 140 is disposed with multiple stopping points (in fact the stopping points actually are lines on the horizontal plane and perpendicular to an extension direction of the movable terminal 2, and viewed as points when viewed from the side surface 13, and the multiple points (lines) are connected to form the curved surface), which exert an stopping effect in sequence from a position close to the receiving slot 15. Among the four side walls 141, two side walls 141 are made to be slopes for convenience of guiding the upper insulating seat 4 to be positioned in the housing cavity 14, and lower ends of the two side walls 141 are inclined towards the middle of the housing cavity 14. That is to say, the inner diameter of the housing cavity 14 decreases gradually from top to bottom. The upper surface 11 is disposed with a protruding reinforcing block 16 located on a periphery of the receiving slot 15. In this embodiment, the reinforcing block 16 is located just over the receiving slot 15.

Figure 7:
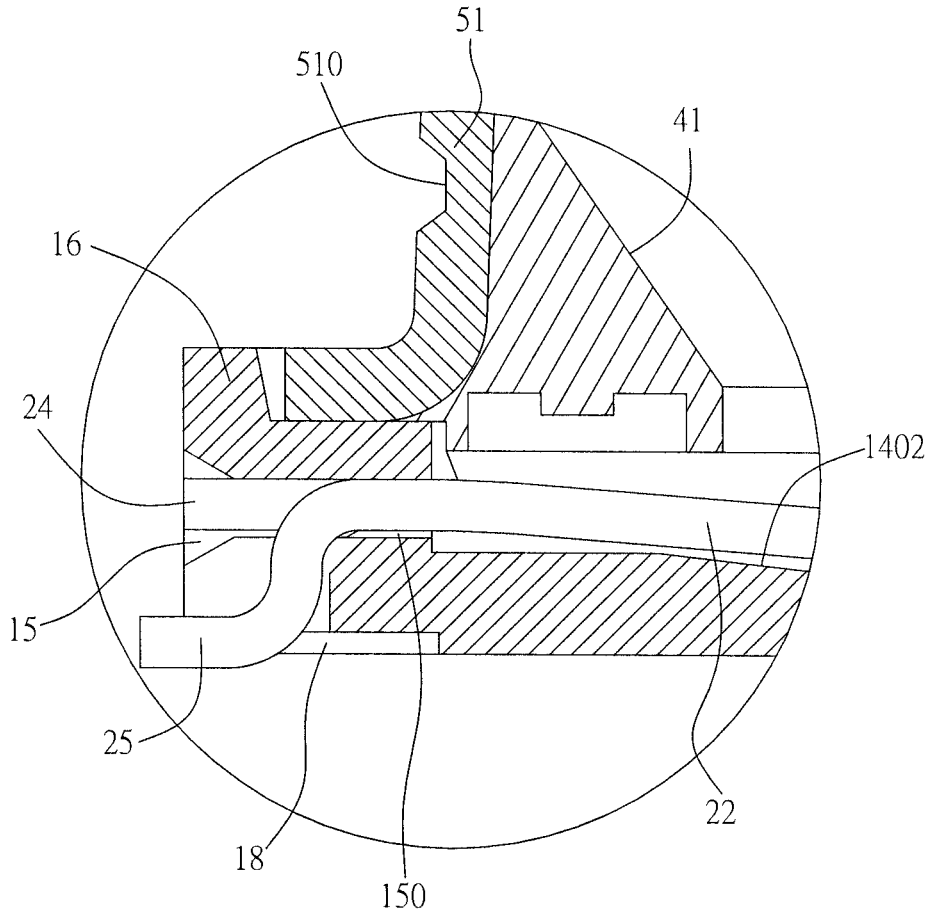
FIG. 7 is a partially enlarged view of FIG. 6.
Figure 8:
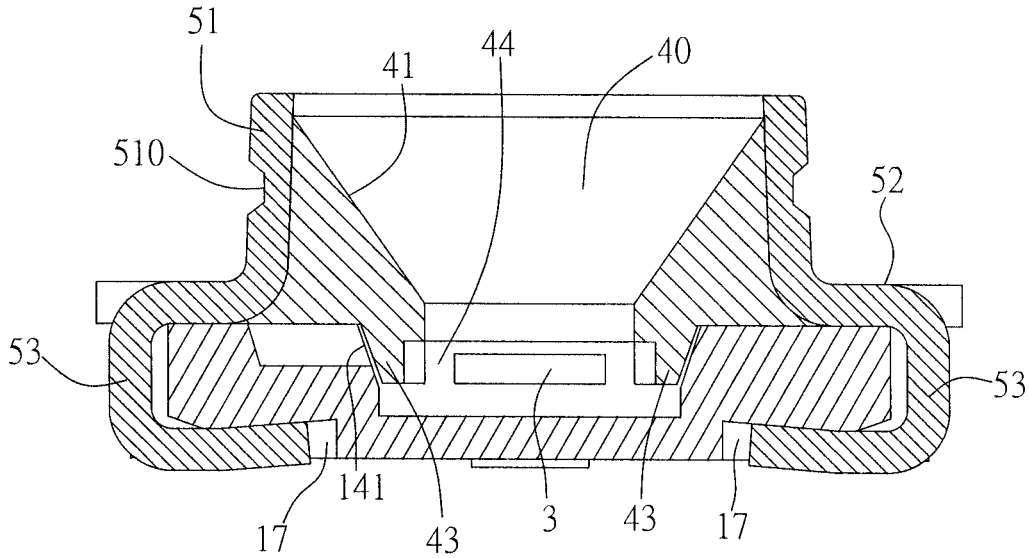
FIG. 8 is a cutaway view along a B-B line in FIG. 2.

Referring to FIGS. 2 and 8, the lower insulating seat 1 has two make-way slots 17 recessed from two opposite sides of the lower surface 12. Portions of the make-way slots 17 close to the middle of the lower surface 12 are disposed to be inclined upwards. Two recessed slots 18 are recessed from the other two opposite sides of the lower surface 12, and as shown in FIG. 7, one of the recessed slots 18 is located just under the receiving slot 15.

Referring to FIGS. 3-7, the movable terminal 2 is made by processing a metal plate by punching, bent to be Z-shaped, and is mounted in the lower insulating seat 1 by insertion. The movable terminal 2 has a retained portion 21 retained in the receiving slot 15. The retained portion 21 and inner walls of the receiving slot 15 are in an interference fit state. A contact portion 22 extends transversely from the retained portion 21 towards the housing cavity 14, and enters the housing cavity 14. A pressed portion 23 further extends transversely from the contact portion 22, and is located in the housing cavity 14. An end of the pressed portion 23 is bifurcated to form two contact points. The retained portion 21, the contact portion 22, and the pressed portion 23 are coplanar. A first strip-connecting portion 24 extends from the retained portion 21 in a direction leaving the housing cavity 14. The first strip-connecting portion 24 and the retained portion 21 are coplanar. In this embodiment, the number of the first strip-connecting portions 24 is two, and the two first strip-connecting portions 24 are located on two sides of the retained portion 21 respectively. Two support points 150 are disposed in the receiving slot 15, and under the first strip-connecting portions 24. The two support points 150 urge against the two first strip-connecting portions 24 respectively. The retained portion 21 is bent downwards, and a first soldering portion 25 extends from the retained portion 21 in a direction leaving the housing cavity 14. The first soldering portion 25 enters one of the recessed slots 18, and a lower part thereof exceeds the lower surface 12. The movable terminal 2 is inserted into the housing cavity 14, and is just over the bottom wall 140. The gap is defined between the lower surface of the movable terminal 2 and the horizontal plane 1401 of the bottom wall 140, and a distance between the lower surface of the movable terminal 2 and the bottom wall 140 increases gradually in a direction from the retained portion 21 to the pressed portion 23.

Referring to FIGS. 3-7, the fixed terminal 3 is also made by processing a metal plate by punching, bent to be Z-shaped by pressing, substantially as wide as the movable terminal 2, and is integrally formed with the lower insulating seat 1 through an insert molding process. The fixed terminal 3 is embedded in the lower insulating seat 1 and on another side of the lower insulating seat 1 opposite to the movable terminal 2, and has a fixed portion 31 embedded in the lower insulating seat 1. The fixed portion 31 and the retained portion 21 of the movable terminal 2 are coplanar. A pressing portion 32 extends from the fixed portion 31 towards the housing cavity 14, and enters the housing cavity 14. The pressing portion 32 and the fixed portion 31 are coplanar. When the mating electrical connector 200 is not inserted, the pressing portion 32 urges downwards against the pressed portion 23, and elastically presses the two contact points of the pressed portion 23. A second soldering portion 33 is bent downwards from the fixed portion 31, extends in a direction leaving the housing cavity 14, is coplanar with the first soldering portion 25, and is exposed from the lower surface 12. Specifically, the second soldering portion 33 enters the other one of the recessed slots 18, and a lower part thereof exceeds the lower surface 12. A second strip-connecting portion 34 further extends transversely from the second soldering portion 33 in a direction leaving the housing cavity 14, and the second strip-connecting portion 34 and the first strip-connecting portion 24 are in different planes in a vertical direction.

Figure 5:
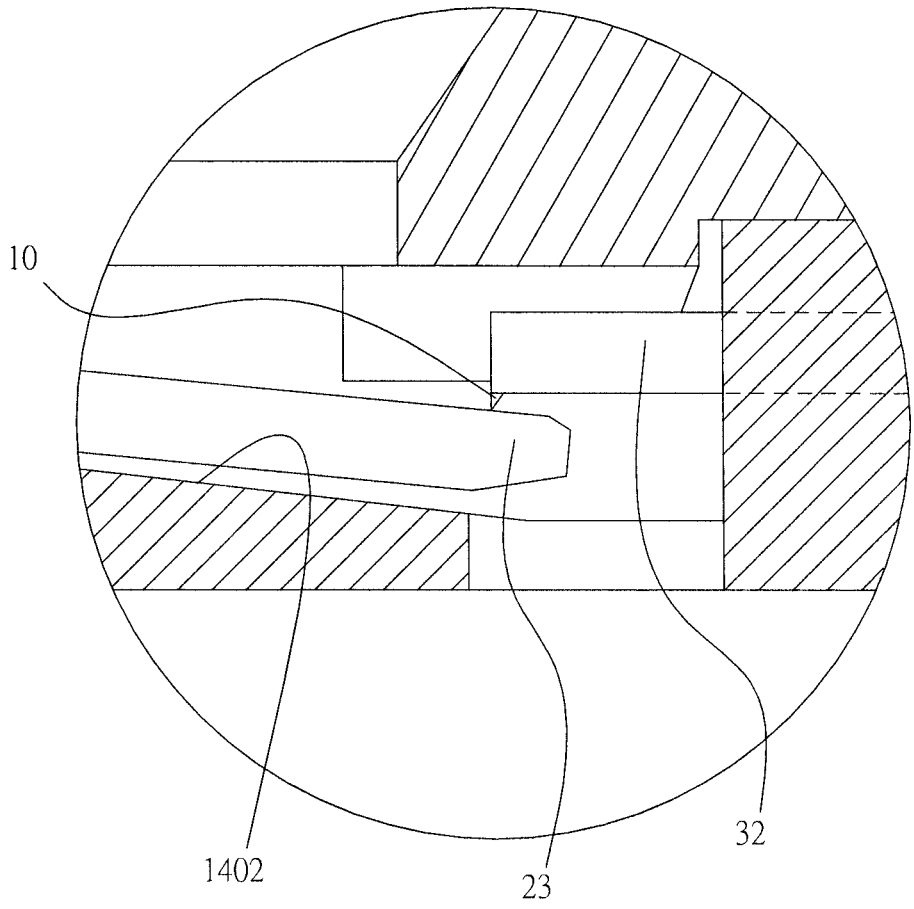
FIG. 5 is a partially enlarged view of FIG. 4.

In this embodiment, the fixed terminal 3 and the lower insulating seat 1 are integrally formed through the insert molding process, and during the insert molding process a work piece is required to fix the fixed terminal 3, so that a hole in communication with the housing cavity 14 is left in the bottom surface 12 of the lower insulating seat 1. During a subsequent process of soldering the second soldering portion 33 to a circuit board (not shown), flux (normally an insulating material or a material with great resistance) of solder enters the housing cavity 14 through the hole of the bottom surface 12, and may be attached to and embrace a surface of the movable terminal 2, which results in poor contact between the pressing portion 32 and the pressed portion 23. In order to solve the problem, a pointed portion 10 protruding towards the pressed portion 23 may be disposed on the pressing portion 32. As shown in FIG. 5, the pointed portion 10 may pierce a flux layer on the surface of the movable terminal 2 and contact with the pressed portion 2 well. Definitely, in other embodiments the pointed portion 10 may also be disposed on the pressed portion 23, and protrude toward the pressing portion 32, which is not described in detail.

Referring to FIGS. 3-7, the upper insulating seat 4 is mounted above the lower insulating seat 1. The upper insulating seat 4 is a column, and an insertion slot 40 to be inserted into by the pin 6 of the mating electrical connector 200 is opened in the column. The insertion slot 40 is in communication with the housing cavity 14. An inner wall surface of the insertion slot 40 is disposed with a guiding slope 41 for guiding the insertion of the pin 6. The upper insulating seat 4 has a lower wall surface 42 fit with the upper surface 11 of the lower insulating seat 1. A gap is defined between the lower wall surface 42 and the upper surface of the movable terminal 2. Two positioning protrusions 43 protrude from the lower wall surface 42 towards the inside of the housing cavity 14. Outer sides of the positioning protrusions 43 are inclined to match the two inclined side walls 141. A part between the two positioning protrusions 43 is recessed upwards to form a recessed portion 44. The recessed portion 44 is slightly larger than the movable terminal 2 and the fixed terminal 3 in width, and is used to make way for the movable terminal 2, so as to prevent the positioning protrusions 43 from contacting with the upper surface of the movable terminal 2 to damage the movable terminal 2 by pressing.

Referring to FIG. 2 and FIG. 3, the metal shell 5 is integrally formed on the periphery of the upper insulating seat 4. That is, the upper insulating seat 4 and the metal shell 5 are made through the insert molding process. The metal shell 5 includes a cylindrical portion 51 and a plane portion 52. The cylindrical portion 51 surrounds the column, an outer side of the cylindrical portion 51 is disposed with a holding portion 510, and the holding portion 510 is used to hold the casing 7 of the mating electrical connector 200. In this embodiment, the holding portion 510 is a ring-shaped groove. The plane portion 52 covers the upper surface 11 of the lower insulating seat 1, and contacts with the reinforcing block 16 laterally. The reinforcing block 16 exerts a limiting effect on the metal shell 5. Two embracing portions 53 are bent downwards from the plane portion 52 and extend. As shown in FIG. 8, two ends of the two embracing portions 53 correspondingly enter the make-way slots 17 to embrace the side walls 141 and the lower surface 12.

The coaxial connector 100 according to this embodiment is made through the following steps.

Figure 9:
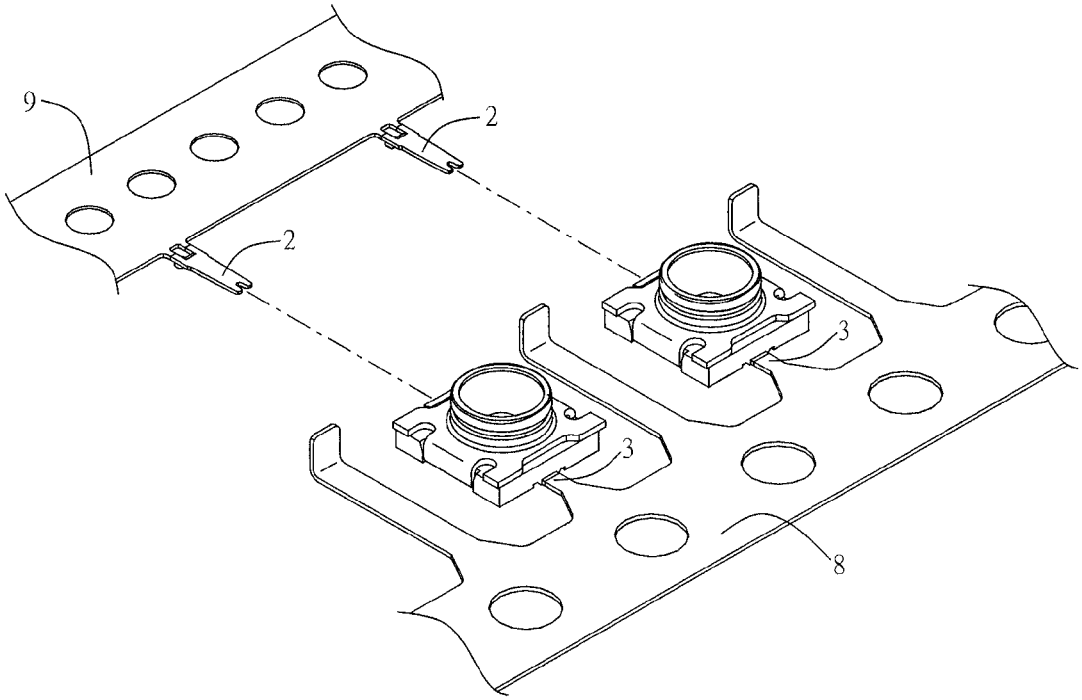
FIG. 9 is a schematic structural view of a connecting-strip of a coaxial connector according to one embodiment of the present invention.

1. Multiple fixed terminals 3 and multiple movable terminals 2 are respectively made by processing metal plates by punching and bending, the multiple fixed terminals 3 are connected to a first strip 8, and the multiple movable terminals 2 are connected to a second strip 9, as shown in FIG. 9.

2. The first strip 8 together with the multiple fixed terminals 3 is placed in a mold, multiple lower insulating seats 1 are formed by insert molding, and the lower insulating seats 1 have the structures described above.

3. The second strip 9 together with the multiple movable terminals 2 is inserted into the multiple lower insulating seats 1, and it is ensured that the pressed portions 23 of the movable terminal 2 press upwards against the pressing portions 32 of the fixed terminal 3 and are elastically pressed by the pressing portion 32.

4. Multiple metal shell 5 formed by insert molding and the upper insulating seats 4 are integrally mounted on the multiple lower insulating seats 1 correspondingly, and the embracing portions 53 are bent to enter the make-way slots 17.

5. The first strip 8 and the second strip 9 are removed.

Figure 6:
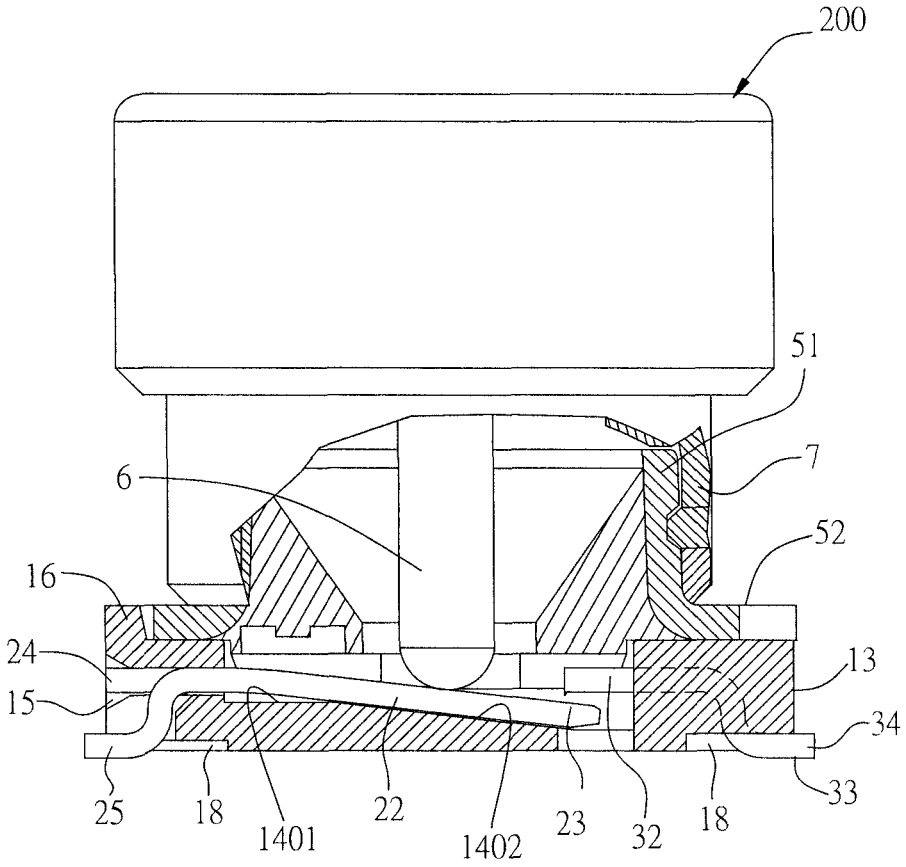
FIG. 6 is a schematic view after a mating electrical connector is inserted into a coaxial connector according to one embodiment of the present invention.

Referring to FIG. 4, when the mating electrical connector 200 is not inserted, the pressed portion 23 of the movable terminal 2 urges against the lower surface of the pressing portion 32 of the fixed terminal 3, and is elastically pressed by the pressing portion 32. The fixed portion 31, the contact portion 22, and the pressed portion 23 are in an inclined state. The pressing portion 32 elastically presses downwards against the free end, that is, the pressed portion 23 of the movable terminal 2, so that a normal force exists between the pressed portion 23 and the pressing portion 32, which therefore are in close contact, and at this moment the switch circuit is in a close state. Referring to FIG. 6, when the pin 6 is inserted downwards, the pin 6 enters the insertion slot 40 from the guiding slope 41, and continues to move until the pin 6 urges against the contact portion 22 of the movable terminal 2, and when the casing 7 of the mating electrical connector 200 is held by the holding portion 510 on the outer side of the metal shell 5, the contact portion 22 under a pushing force from the pin 6 moves downwards and drives the pressed portion 23 to move downwards until the pressed portion 23 is separated from the pressing portion 32, and at this moment, the switch circuit is in a cut off state. When the contact portion 22 is moving downwards, the bottom wall 140 of the housing cavity 14 can prevent the movable terminal 2 from being over-pressed downwards. Specifically, an intersecting part of the horizontal plane 1401 and the slope 1402 contacts with the lower surface of the movable terminal 2 first and exerts a stopping effect on the movable terminal 2. As the contact portion 22 continues moving downwards, the part on the slope 1402 contacts with the lower surface of the movable terminal 2 from left to right (according to a direction in FIG. 6) in sequence.

The present invention, among other things, has the following beneficial effects.

1. The contact portion 22 of the movable terminal 2 extends transversely from the retained portion 21 without being bent. The fixed terminal 3 is also in the shape of a flat board. The two terminals are simple in structure, which simplifies the manufacturing process and reduces the space occupied by the two terminals in a vertical direction, thereby being conducive to making the coaxial connector 100 thinner and smaller. On the basis that the retained portion 21 of the movable terminal 2 and the fixed portion 31 of the fixed terminal 3 are coplanar, the pressed portion 23 extends to the position under the pressing portion 32, and the structure can ensure a sufficient normal force between the two terminals being very simple in structure.

2. The fixed terminal 3 is integrally embedded in the lower insulating seat 1 by insert molding, so that the structure is easy to manufacture and has the steady size. The movable terminal 2 is mounted in the receiving slot 15 by inserting after the lower insulating seat 1 is formed and cooled, so that a normal force between the movable terminal 2 and the fixed terminal 3 is enabled to be large, and at the same time the lower insulating seat 1 is prevented from being deformed by a pushing effect exerted by the normal force of the two terminals during a cooling process after the insert molding.

3. The movable terminal 2 and the fixed terminal 3 can be respectively connected to the strips for insert molding, and inserted into the lower insulating seat 1, thereby making mass mounting and production convenient and simplifying the assembly process. The first strip-connecting portion 24 of the movable terminal 2 is slightly above the middle of the lower insulating seat 1 in a vertical direction, so that when the movable terminal 2 is being inserted into the receiving slot 15 the movable terminal 2 endures a concentrated force, which makes the insertion easier. The reinforcing block 16 above the receiving slot 15 can increase the strength of the lower insulating seat 1, so that when the movable terminal 2 is being inserted into the receiving slot 15 or the strip is being broken, a too heavy impact caused by the movable terminal 2 does not crack the lower insulating seat 1.

4. The second strip-connecting portion 34 of the fixed terminal 3 is located on the lower surface 12 of the lower insulating seat 1, so that compared with the structure in the prior art in which the strip-connecting portion is in the middle of the insulating main body, when the strip of the fixed terminal 3 is being broken, even if the strip-connecting portion vibrates vertically, the strip-connecting portion contacts with only the lower surface 12, which dose not cause the lower insulating seat 1 to crack.

5. The first soldering portion 25 extends in a direction leaving the housing cavity 14, so that compared with the Π-shaped structure in which the soldering portion is bent inwards (in the structure the metal plate is required to be processed by punching and bending twice), the Z-shaped structure only requires the metal plate to be processed by punching and bending once to form the first soldering portion 25, thereby being conducive to simplifying the manufacturing process.

6. The bottom wall 140 is under the movable terminal 2, and the bottom wall 140 is disposed to be a slope, so that the bottom wall 140 can exert a stopping effect on the movable terminal 2 in sequence from the position of the retained portion 21 along the extension direction of the movable terminal 2, thereby preventing the movable terminal 2 from being over-pressed and the movable terminal 2 from deforming permanently.

7. Two support points 150 are disposed in the receiving slot 15 and under the first strip-connecting portion 24, so that the retained portion 21 is slightly raised, and when the pressed portion 23 is elastically pressed downwards by the pressing portion 32, an angle between the retained portion 21 and the pressed portion 23 increases, thereby exerting a larger normal force on the pressed portion 23 and ensuring reliable contact between the pressed portion 23 and the pressing portion 32.

8. The upper insulating seat 4 is disposed with the positioning protrusions 43, and the side walls 141 of the housing cavity 14 are slopes, so that the slopes can guide the positioning protrusions 43 to enter the housing cavity 14, and the upper insulating seat 4 can be mounted to the lower insulating seat 1 successfully.

9. After the movable terminal 2 is inserted and before the upper insulating seat 4 is mounted to the lower insulating seat 1, dust and impurities in that air may drop on the movable terminal 2, and when the upper insulating seat 4 is mounted, if the lower wall surface 42 of the upper insulating seat 4 and the upper surface of the movable terminal 2 are closely fit, the upper insulating seat 4 is likely to press the movable terminal 2 to damage the movable terminal 2. However, in the present invention, a gap between the lower wall surface 42 of the upper insulating seat 4 and the movable terminal 2 is intentionally kept, thereby avoiding the aforementioned negative result.

10. The lower surface 12 of the lower insulating seat 1 is disposed with the make-way slots 17, and the embracing portions 53 enter the make-way slots 17, so that the embracing portions 53 can embrace the upper insulating seat 4 and the lower insulating seat 1 tightly, thereby achieving a closer and more reliable combination of the upper insulating seat 4 and the lower insulating seat 1.

In short, the coaxial connector 100 according to the embodiments of the present invention is small, able to not only ensure the normal force of the terminals of the switch but also make the mounting of the terminals of the switch and the insulating main body convenient, not likely to damage the insulating main body, and highly reliable.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A coaxial connector, used to be coupled to a mating electrical connector inserted downwards, comprising:

(a) a lower insulating seat, having an upper surface and a lower surface opposite to each other, wherein a housing cavity is recessed from the upper surface, the lower insulating seat is disposed with a receiving slot located on one side of the housing cavity and in communication with the housing cavity, and the lower insulating seat is further disposed with a protruding reinforcing block located on a periphery of the receiving slot;

(b) a movable terminal, having a retained portion retained in the receiving slot, wherein a contact portion extends transversely from one end of the retained portion and enters the housing cavity, a pressed portion extending transversely from the contact portion is located in the housing cavity, a first soldering portion is bent downwards and extends from the other end of the retained portion, a first strip-connecting portion extends from the retained portion in a direction leaving the housing cavity, and the first strip-connecting portion and the contact portion are substantially coplanar;

(c) a fixed terminal, integrally embedded in the lower insulating seat, wherein the fixed terminal has a fixed portion embedded in the lower insulating seat, the fixed portion and the retained portion of the movable terminal are coplanar, a pressing portion extends transversely from one end of the fixed portion and enters the housing cavity, the pressing portion elastically presses downwards against the pressed portion, a second soldering portion is bent downwards from the other end of the fixed portion, extends in a direction leaving the housing cavity, and is exposed from the lower surface, the second soldering portion and the first soldering portion are coplanar, a second strip-connecting portion extends transversely from the second soldering portion, and the second strip-connecting portion and the first strip-connecting portion are in different planes;

(d) an upper insulating seat, mounted on the upper surface of the lower insulating seat, wherein the upper insulating seat is disposed with an insertion slot to be inserted into by the mating electrical connector and in communication with the housing cavity, and a guiding slope is disposed in the insertion slot to guide the mating electrical connector to enter; and (e) a metal shell, disposed on a periphery of the upper insulating seat, wherein the metal shell has an embracing portion bent and extending towards the lower insulating seat for embracing the lower surface of the lower insulating seat, and an outer side of the metal shell is disposed with a holding portion to hold the mating electrical connector;

wherein when the mating electrical connector enters the insertion slot from the guiding slope and urges against the contact portion of the movable terminal, and a casing of the mating electrical connector is held at the holding portion on the outer side of the metal shell, the pressed portion of the movable terminal is separated from the pressing portion of the fixed terminal, thereby forming a switch circuit capable of switching a signal.

2. The coaxial connector according to claim 1, wherein the movable terminal and the fixed terminal are disposed to be opposite to each other, and the pressed portion and the pressing portion extend towards each other.

3. The coaxial connector according to claim 1, wherein the first soldering portion extends in a direction away from the housing cavity.

4. The coaxial connector according to claim 1, wherein the housing cavity has a bottom wall located under the movable terminal, and after the pressed portion is separated from the pressing portion, the bottom wall stops the movable terminal.

5. The coaxial connector according to claim 4, wherein a distance from the bottom wall to the movable terminal increases gradually along a direction from the retained portion to the pressed portion.

6. The coaxial connector according to claim 4, wherein the bottom wall is a slope.

7. The coaxial connector according to claim 4, wherein the bottom wall is a curved surface.

8. The coaxial connector according to claim 1, wherein the reinforcing block is disposed at the upper surface, and contacts with the metal shell laterally to limit the metal shell.

9. The coaxial connector according to claim 1, wherein the movable terminal is disposed with two first strip-connecting portions located on two sides of the retained portion, two support points disposed in the receiving slot are located under the first strip-connecting portions, and the two support points urge against the two first strip-connecting portions respectively.

10. The coaxial connector according to claim 1, wherein the upper insulating seat has a lower wall surface fit with the upper surface of the lower insulating seat, and a gap exists between the lower wall surface and the movable terminal.

11. The coaxial connector according to claim 10, wherein the lower wall surface is disposed with a positioning protrusion which protrudes towards the lower insulating seat and enters the housing cavity.

12. The coaxial connector according to claim 11, wherein the housing cavity has a side wall, and the side wall is a slope to guide the positioning protrusion to enter the housing cavity.

13. The coaxial connector according to claim 1, wherein the upper insulating seat is integrally embedded in the metal shell.

14. The coaxial connector according to claim 1, wherein the pressed portion of the movable terminal is bifurcated to form two contact points contacting with the pressing portion.

15. The coaxial connector according to claim 1, wherein the lower surface of the lower insulating seat is disposed with a recessed make-way slot corresponding to the embracing portion, and a free end of the embracing portion enters the make-way slot.

16. The coaxial connector according to claim 15, wherein a part of the make-way slot close to the middle of the lower surface is inclined upwards.

17. The coaxial connector according to claim 1, wherein a pointed portion protruding from the pressing portion contacts with the pressed portion.

18. The coaxial connector according to claim 1, wherein a pointed portion protruding from the pressed portion contacts with the pressing portion.

* * * * *